US009282417B2

(12) United States Patent
Harma et al.

(10) Patent No.: US 9,282,417 B2
(45) Date of Patent: Mar. 8, 2016

(54) SPATIAL SOUND REPRODUCTION

(75) Inventors: Aki Sakari Harma, Eindhoven (NL); Werner Paulus Josephus De Bruijn, Eindhoven (NL)

(73) Assignee: KONINKLIJKE N.V., Eindhoven (NL)

( * ) Notice: Subject to any disclaimer, the term of this patent is extended or adjusted under 35 U.S.C. 154(b) by 411 days.

(21) Appl. No.: 13/521,069

(22) PCT Filed: Jan. 26, 2011

(86) PCT No.: PCT/IB2011/050334

§ 371 (c)(1),
(2), (4) Date: Jul. 9, 2012

(87) PCT Pub. No.: WO2011/095913

PCT Pub. Date: Aug. 11, 2011

(65) Prior Publication Data

US 2012/0328109 A1 Dec. 27, 2012

(30) Foreign Application Priority Data

Feb. 2, 2010 (EP) ..... 10152388

(51) Int. Cl.
*H04H 40/54* (2008.01)
*H04S 3/00* (2006.01)
*H04S 5/00* (2006.01)

(52) U.S. Cl.
CPC ..... *H04S 3/002* (2013.01); *H04S 5/005* (2013.01); *H04S 2400/03* (2013.01)

(58) Field of Classification Search
CPC ..... H04R 5/00; H04B 1/1676; H04B 1/1684
USPC ..... 381/17, 22–23, 10–11, 1; 704/500, 704/E19.001
See application file for complete search history.

(56) References Cited

U.S. PATENT DOCUMENTS 6,198,827 B1 3/2001 Waller, Jr.
7,065,217 B2 * 6/2006 Gierl et al. ..... 381/10

(Continued)

FOREIGN PATENT DOCUMENTS

RU 2145446 C1 2/2000
WO 0149074 A2 7/2001

(Continued)

OTHER PUBLICATIONS

C. Avendano: Frequency-Domain Source Identification and Manipulation in Stereo Mixes for Enhancement, Suppression and Re-Panning Applications; 2003 IEEE Workshop on Applications of Signal Processing to Audio and Acoustics, Oct. 2003, New Paltz, NY, pp. 55-58.

(Continued)

*Primary Examiner* — Disler Paul

(57) ABSTRACT

An apparatus for spatial sound reproduction comprises a receiver (101) for receiving a multi-channel audio signal. An analyzer (107) determines a spatial property of the multi-channel audio signal, such as a spatial complexity or organization. A selection processor (109) then selects a reproduction mode from a plurality of sound reproduction modes where the multi-channel sound reproduction modes employ different spatial rendering techniques. A reproduction circuit (103) then drives a set of loudspeakers (105) to reproduce the multi-channel audio signal using the selected reproduction mode. The switching between the reproduction modes may be fast (e.g. in the order of 100 ms to 10 secs) thereby allowing a short term adaptation of the reproduction mode to the signal characteristics. The approach may in particular provide an improved spatial experience to a listener.

12 Claims, 3 Drawing Sheets

(56) References Cited

U.S. PATENT DOCUMENTS

| | | | | |
|---|---|---|---|---|
| 7,983,922 | B2 * | 7/2011 | Neusinger et al. | 704/500 |
| 8,010,373 | B2 * | 8/2011 | Myburg et al. | 704/500 |
| 8,331,572 | B2 * | 12/2012 | Breebaart et al. | 381/22 |
| 2008/0160943 | A1 | 7/2008 | Sung et al. | |
| 2008/0175394 | A1 | 7/2008 | Goodwin | |
| 2009/0022337 | A1 * | 1/2009 | Sakai et al. | 381/104 |
| 2009/0046997 | A1 | 2/2009 | Park et al. | |
| 2009/0136048 | A1 | 5/2009 | Yoo et al. | |
| 2010/0226499 | A1 * | 9/2010 | De Bruijn et al. | 381/17 |
| 2010/0284549 | A1 * | 11/2010 | Oh et al. | 381/119 |

FOREIGN PATENT DOCUMENTS

| | | | |
|---|---|---|---|
| WO | 0207481 | A2 | 1/2002 |
| WO | 2006027717 | A1 | 3/2006 |
| WO | 2006056910 | A1 | 6/2006 |
| WO | 2008031611 | A1 | 3/2008 |
| WO | 2009046223 | A2 | 4/2009 |
| WO | 2009046460 | A2 | 4/2009 |

OTHER PUBLICATIONS

Goodwin et al: "Multichannel Surround Format Conversion and Generalized Upmix"; AES 30th International Conference, Saariselka, Finland, Mar. 2007, pp. 1-9.

Harma et al: "Spatial Decomposition of Time-Frequency Regions: Subbands or Sinusoids"; AES 116th International Convention, May 2004, Berlin Germany, pp. 1-9.

Bai et al: "Upmixing and Downmixing Two-Channel Stereo Audio for Consumer Electronics"; IEEE Tran. Cons. Elect., 53/3, 2007, pp. 1101-1019.

Goodwin et al: "Multichannel Surround Format Conversation and Generalized Upmix"; AES 30TH International Conference, Saariselka, Finland, 2007, pp. 1-9.

Harma et al: "Spatial Decomposition of Time-Frequency Regions: Subbands or Sinusoids"; AES Convention Paper 6061, Berlin, Germany, 2004, pp. 1-9.

Yamamoto et al: "Estimation of the Number of Sound Sources Using Support Vector Machines and its Application to Sound Source Separation"; IEEE ICASSP 2003, pp. V-485-V-488.

* cited by examiner

SPATIAL SOUND REPRODUCTION

FIELD OF THE INVENTION

The invention relates to spatial sound reproduction and in particular, but not exclusively, to spatial sound reproduction including upmixing of a multi-channel audio signal.

BACKGROUND OF THE INVENTION

Spatial sound reproduction in the form of stereo recordings and reproduction has been around for several decades. In the last decades, more advanced arrangements and signal processing have been used to provide improved spatial listening experiences. In particular, the use of surround sound using e.g. 5 or 7 spatial speakers has become prevalent to provide an enhanced experience in connection with e.g. viewing of movies or television. In addition, compact multi-driver loudspeaker systems such as 'sound bars' have become popular option for the traditional stereo and 5.1 systems. Those devices provide an experience of a wide spatial audio image for a listener even from a small device. This is based on digital processing of the signals and special physical arrangement of the device.

Spatial sound processing increasingly utilizes advanced signal processing as part of the sound reproduction to provide an improved spatial experience. For example, complex algorithms may be used to upmix an audio signal to a higher number of channels. For example, a 5 channel surround signal may at the transmitting side be downmixed to a stereo or mono signal. This signal is then distributed and the sound reproduction includes an upmixing of the received signal to the original 5-channel signal.

As another example, signal processing may be used to provide a sound widening effect to a stereo signal resulting in the listener experiencing a wider sound stage. Typically the methods are based on signal processing operations that reduce the correlation between the channels. These techniques are particularly popular in the compact loudspeaker systems mentioned above.

As another example, reproduction of a spatial signal may include an extraction of a dominating sound source in e.g. a stereo signal. The remaining residual signal will typically correspond to the ambient stereo image which is more diffuse. The dominant signal and the ambient signal may then be reproduced differently such that the reproduction characteristics are optimized for each signal.

However, although such spatial sound reproduction techniques improve the listening experiences, there tends to be some associated disadvantages. In particular, the reproduction may not provide an optimal spatial experience in all situations and the signal processing may in some cases actually result in a degraded spatial experience.

Hence, an improved system for spatial sound reproduction would be advantageous and in particular a system allowing for increased flexibility, facilitated operation, facilitated implementation, an improved spatial listening experience and/or improved performance would be advantageous.

SUMMARY OF THE INVENTION

Accordingly, the Invention seeks to preferably mitigate, alleviate or eliminate one or more of the above mentioned disadvantages singly or in any combination.

According to an aspect of the invention there is provided an apparatus for spatial sound reproduction, the apparatus comprising: a receiver for receiving a multi-channel audio signal; a circuit for determining a spatial property of the multi-channel audio signal; a circuit for selecting a selected reproduction mode from a plurality of sound reproduction modes, the multi-channel sound reproduction modes employing different spatial rendering techniques; and a reproduction circuit for driving a set of spatial channels provided by a set of loudspeakers to reproduce the multi-channel audio signal using the selected reproduction mode.

The invention may provide improved sound reproduction in many embodiments. In particular, an improved spatial experience may be provided in many scenarios. Typically, the spatial reproduction may be improved for the specific audio signal. The Approach may further allow a low complexity implementation and facilitated operation in many embodiments.

The selection of an appropriate reproduction method may be optimized for the specific conditions experienced while maintaining low complexity.

The spatial property may be indicative of a spatial organization and/or a spatial complexity of the signal. For example, the spatial property may be indicative of the presence of one or more dominant sound sources in accordance with a suitable criterion or process for extracting dominant sound sources. In some embodiments, the spatial property may be indicative of a spatial distribution of sounds sources in the sound image represented by the multi-channel signal.

The set of loudspeakers may specifically be loudspeakers of a surround sound setup comprising e.g. 3, 5 or 7 spatial speakers (in addition to possibly a non-spatial Low Frequency Effect speaker or subwoofer). The set of loudspeakers may be multi-driver loudspeaker systems with typically three or more individually driven loudspeakers (or loudspeaker arrays) in one physical device. The set of loudspeakers may also comprise a plurality of such devices.

In accordance with an optional feature of the invention, at least one of the sound reproduction modes comprises at least one of: an upmixing to higher number of spatial channels than a number of channels of the multi-channel audio signal; and a down-mixing to a lower number of spatial channels than the number of channels of the multi-channel audio signal.

The invention may provide an improved spatial experience. For example, some sound images of a stereo signal may provide an improved spatial experience when reproduced as a mono-signal. Other sound images of a stereo signal may provide an improved spatial experience when reproduced as a widened stereo signal combined with a center-signal, i.e. when reproduced using three spatial channels.

In accordance with an optional feature of the invention, the set of spatial channels comprise a different number of channels than the multi-channel audio signal.

The invention may provide an improved spatial experience for a sound reproduction system and may in particular allow additional degrees of freedom in adapting the sound reproduction to the specific sound image and spatial characteristics.

In accordance with an optional feature of the invention, a maximum switch frequency for switching between sound reproduction modes exceeds 1 Hz.

This may provide a dynamic adaptation and optimization which may closely match the varying characteristics of the audio thereby providing an improved listening experience.

The feature may allow improved performance and improved adaptation of the reproduction mode to the audio signal thereby providing an enhanced listening experience. The approach may allow a short term adaptation of the reproduction to the signal characteristics.

In some embodiments, a maximum switch frequency for switching between reproduction modes may exceed 0.01 Hz; 0.1 Hz, or even 10 Hz.

The maximum switch frequency may be the maximum frequency at which the apparatus can switch between reproduction modes. The maximum frequency may be restricted by the design parameters of the system including characteristics of the spatial property estimation and switching functionality.

In accordance with an optional feature of the invention, the circuit for determining the spatial property is arranged to determine the spatial property with a time constant of no more than 10 seconds.

This may provide a dynamic adaptation and optimization which may closely match the varying characteristics of the audio thereby providing an improved listening experience.

The feature may allow improved performance and improved adaptation of the reproduction mode to the audio signal thereby providing an enhanced listening experience. The approach may allow a short term adaptation of the reproduction to the signal characteristics.

In some embodiments, the circuit for determining the spatial property may advantageously be arranged to determine the spatial property with a time constant of less than 500 seconds, 100 seconds, 1 second, 500 ms, 100 ms or even 50 ms.

The time constant represents the time it takes the spatial property to reach 1-1/e•63% of its final (asymptotic) value following a step change.

In some embodiments, the circuit for determining the spatial property is arranged to include a low pass filtering of the spatial property, the low pass filtering having a 3 dB cut-off frequency exceeding 0.001 Hz, 0.01 Hz, 0,1 Hz, 1 Hz, 10 Hz or 50 Hz.

In accordance with an optional feature of the invention, the plurality of sound reproduction modes comprises at least one of: a monophonic reproduction mode; a reproduction mode maintaining spatial characteristics of the multi-channel signal; a reproduction mode comprising spatial widening processing; and a reproduction mode comprising a separation into at least one dominant source signal and an ambiance signal, and applying different spatial reproduction of the at least one primary source signal and the ambiance signal.

These reproduction techniques may be particular advantageous and suited to provide improved listening characteristics for different audio characteristics. In many embodiments, the plurality of sound reproduction modes may advantageously comprise two, three or all four reproduction modes as these are particularly suited to different characteristics, and thus together provide a set of modes that provide improved reproduction for a large range of audio characteristics. The techniques may specifically together provide suitable reproduction characteristics for a wide range of audio signals.

In accordance with an optional feature of the invention, the apparatus further comprises: a circuit for determining a content characteristic for the multi-channel audio signal; and wherein the circuit for selecting is arranged to further select the selected reproduction algorithm in response to the content characteristic.

This may further improve the adaptation of the reproduction and provide an improved spatial experience in many embodiments. The content characteristic may for example be determined by a content analysis of the multi-channel audio signal and/or an associated video signal.

In accordance with an optional feature of the invention, the circuit for determining the content characteristic is arranged to determine the content characteristic in response to metadata associated with the multi-channel audio signal.

This may provide a particularly accurate and low complexity approach that may be advantageous in many embodiments.

In accordance with an optional feature of the invention, the circuit for reproducing the multi-channel audio signal is arranged to adapt a characteristic of a spatial rendering technique of the selected reproduction mode in response to the content characteristic.

This may further improve the adaptation of the reproduction and provide an improved spatial experience in many embodiments.

In accordance with an optional feature of the invention, the circuit for reproducing the multi-channel audio signal is arranged to adapt a characteristic of a spatial rendering technique of the selected reproduction mode in response to the spatial property.

This may further improve the adaptation of the reproduction and provide an improved spatial experience in many embodiments.

In accordance with an optional feature of the invention, the spatial processing characteristic is a degree of spatial widening applied to at least two channels of the multi-channel audio signal.

This may provide a particularly advantageous optimization as the spatial widening may provide a significantly enhanced spatial experience for some audio characteristics but may degrade the spatial experience for other audio characteristics. Accordingly, an optimization of the spatial widening to the audio characteristics may provide a particularly advantageous performance.

In accordance with an optional feature of the invention, the circuit for reproducing the multi-channel audio signal is arranged to gradually transition from a first selected reproduction algorithm to a second selected reproduction algorithm.

This may provide improved performance and may in particular reduce the noticeability of changing between different reproduction modes. The apparatus may specifically be arranged to, during a transition interval, generate drive signals for the set of loudspeakers using both the first selected reproduction algorithm and the second selected reproduction algorithm and to drive the set of loudspeakers by signals generated as a weighted combination of the drive signals where the weighting is dynamically changed during the transition interval.

In accordance with an optional feature of the invention, the circuit for determining the spatial property is arranged to determine the spatial property in response to an energy indication for a combined signal of at least two channels of the multi-channel audio signal relative to an energy indication for a difference signal of the at least two channels.

This may be a particularly advantageous spatial property for adapting the spatial reproduction. In particular, it may provide an advantageous trade-off between accuracy and complexity for many scenarios.

In accordance with an optional feature of the invention, the circuit for determining the spatial property is arranged to decompose the multi-channel audio signal into at least one dominant sound source signal and a residual signal, and to determine the spatial property in response to an energy indication for the dominant sound source signal relative to an energy indication for the residual signal.

This may be a particularly advantageous spatial property for adapting the spatial reproduction. In particular, it may provide an advantageous trade-off between accuracy and complexity for many scenarios.

According to an aspect of the invention there is provided a method of spatial sound reproduction, the method comprising: receiving a multi-channel audio signal; determining a spatial property of the multi-channel audio signal; selecting a selected reproduction mode from a plurality of sound reproduction modes, the multi-channel sound reproduction modes employing different spatial rendering techniques; and driving a set of loudspeakers to reproduce the multi-channel audio signal using the selected reproduction mode.

These and other aspects, features and advantages of the invention will be apparent from and elucidated with reference to the embodiment(s) described hereinafter.

BRIEF DESCRIPTION OF THE DRAWINGS

Embodiments of the invention will be described, by way of example only, with reference to the drawings, in which.

DETAILED DESCRIPTION OF SOME EMBODIMENTS OF THE INVENTION

The following description focuses on embodiments of the invention applicable to a spatial sound reproduction of a stereo signal using upmixing to three channels. However, it will be appreciated that the invention is not limited to this application but may be applied to many other audio signals and reproduction methods.

Figure 1:
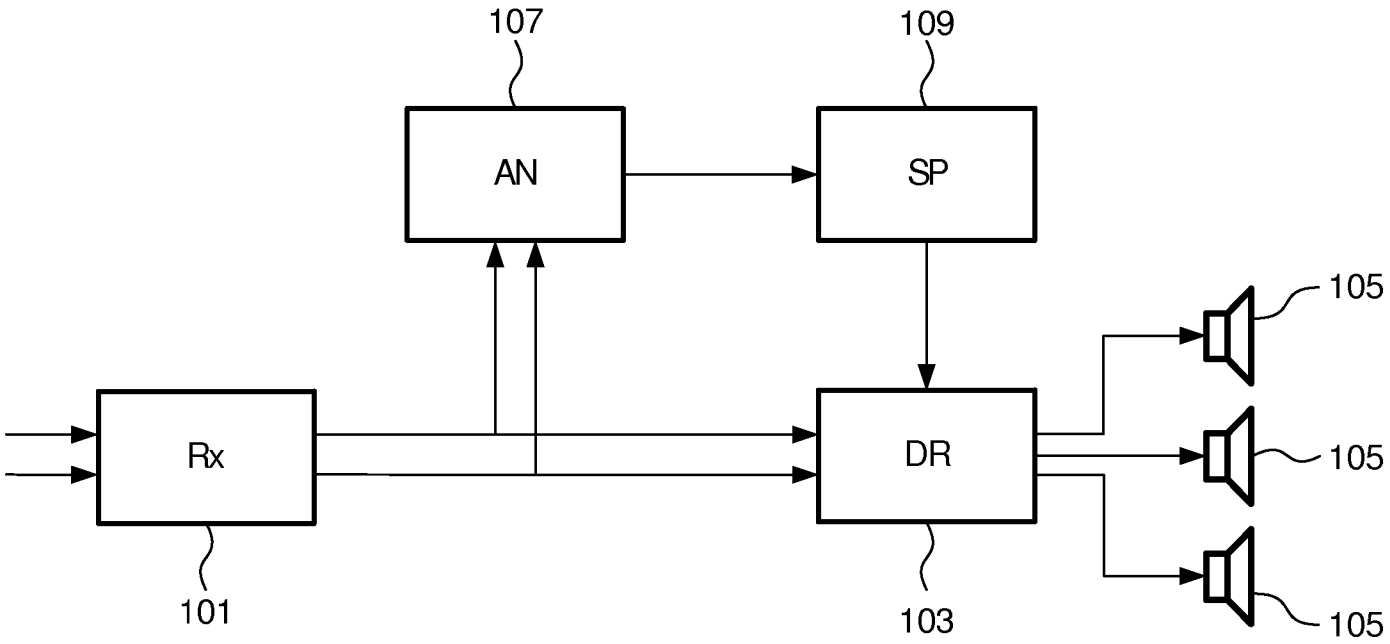
FIG. 1 is an illustration of an example of a system for spatial sound reproduction in accordance with some embodiments of the invention.

FIG. 1 illustrates an example of a system for reproducing sound in accordance with some embodiments of the invention. The system comprises a receiver 101 which receives a spatial audio signal comprising a plurality of audio channels. In the example, the input signal is a stereo signal but it will be appreciated that in other embodiments other numbers of channels may be employed. For example, the input signal may be a five channel surround sound input signal. In some scenarios, the input signal may be an encoded signal and the receiver 101 may be arranged to partially or fully decode the input signal for further processing by the system. For example, for each encoding segment, a frequency representation of the input signal may be generated as the intermediate frequency representation employed by the encoding scheme. It will also be appreciated that plurality of channels of the input signal may be represented by a single encoded audio signal and associated parametric data. For example, the multi channel input signal may be an encoded mono signal and spatial parametric data. As a specific example, the input signal may be a Parametric Stereo signal.

The input multi-channel audio signal may be received from any internal or external source.

The receiver 101 is coupled to a driver circuit 103 which receives the multi-channel (in the specific example the stereo signal) from the receiver 101. The driver circuit 103 generates drive signals for a set of loudspeakers 105. The set of loudspeakers provide a number of spatial channels. In the example, the loudspeakers provide a left channel, a right channel, and a center channel but it will be appreciated that in other embodiments more (or less) spatial channels may be provided. For example, in some embodiments, the loudspeakers may only provide a left and right channel. In other embodiments a full surround system is provided with e.g. five or seven spatial channels.

In some examples, the number of spatial channels provided by the speakers in the set of loudspeakers 105 may be equal to the number of channels in the multi-channel signal. However, in the example, the number spatial channels provided by the set of loudspeakers 105 is higher than the number of channels in the multi-channel signal. In the example, the driver circuit 103 may operate in some reproduction modes which include an upmixing of the channels of the multi-channel signal to the number of spatial channels. Alternatively or additionally, the driver circuit 103 may include functionality for selecting a subset of the available channels in at least some reproduction modes with the subset being different in different reproduction modes. One or more of these modes may further include down-mixing of the input channels. For example, for a stereo input signal, one reproduction mode may provide an output using two of the spatial channels (e.g. the left and right), another reproduction mode may use only one spatial channel (e.g. the center channel), and yet another reproduction mode may use three spatial channels (e.g. the left, right and center channels).

In the specific example, the set of loudspeakers 105 comprises three loudspeakers in a spatial arrangement thereby providing three spatial channels. Thus, the speakers of the set of loudspeakers 105 correspond to a left, right and mid speaker.

The set of loudspeakers is thus arranged to provide a spatial experience. In some embodiments, the driver circuit 103 may know the exact positioning of the loudspeakers relative to a listening position but typically this will not be the case, and the spatial sound reproduction is based on an assumed positioning of the loudspeakers as is known from traditional surround and stereo systems. The set of loudspeakers provide a plurality of spatial channels, e.g. they may provide a left, right and center spatial channel, which are used to provide a spatial experience to the listener. However, the set of loudspeakers need not have a single separate loudspeaker for each channel. For example, the set of loudspeakers may comprise a loudspeaker array and associated driving functionality for providing the spatial channels using audio beamforming techniques. Thus, the loudspeakers of the set of loudspeakers 105 of FIG. 1 may be perceived as the virtual loudspeakers that correspond to a given spatial location or channel. In some embodiments, each virtual loudspeaker may correspond to a physical loudspeaker but this is not necessary in all embodiments.

The driver circuit 103 is arranged to use different sound reproduction modes when driving the loudspeakers 105. The different sound reproduction modes use different spatial rendering techniques. Thus, different sound reproduction modes may apply different spatial processing algorithms and thus the different sound reproduction modes have different spatial audio characteristics. For example, one sound reproduction mode may present the multi-channel signal using only a single loudspeaker 105 (i.e. as a mono reproduction), another reproduction mode may simple drive each loudspeaker with the signal of the corresponding spatial channel without any spatial processing thereby maintaining the spatial characteristics of the input signal. Yet another reproduction mode may spread the input channels over all loudspeakers and introduce spatial widening. Thus, the driver circuit 103 is designed to be able to provide very different spatial processing and to drive the set of loudspeakers 105 with very different properties.

Indeed, the different reproduction modes do not just use different parameter settings for a given spatial processing but applies different underlying principles and in particular use different spatial processing algorithms and methods.

Such a variety of reproduction modes may allow very different effects to be provided by the system and may allow a high variability in the spatial experience of a listener. However, the inventors have realized that whereas spatial signal processing may provide an enhanced experience, it may also in some cases result in a reduced spatial experience. For example, the effect of an audio format conversion algorithm (such as a spatial widening, upmixing, conversion to mono signal etc) on the perceived stereo image may be different for different contents and signal characteristics.

For example, a method may provide a wide spatial image that is suitable for an action movie scene but the same method may be perceived restless and fuzzy in the case of a news program or music with a single instrument. That is, upmixing or stereo widening which may be suitable for one type of content may produce an unwanted effect when used for a different type of content.

As another example, upmixing algorithms that aim at extracting a center channel from a stereo signal may not always work optimally when there is no clear central sound source in the stereo mixture. If a center channel extraction method is used for such content it may result in the reduction of the width of the stereo image.

Allowing the end-user to manually select or adjust the reproduction mode may allow this sensitivity to be mitigated as the user can select the mode providing the most pleasing spatial experience. However, the inventors have realized that such a solution may often not be practical as it only allows a slow and highly cumbersome adaptation.

A solution may be to define a reproduction mode for each possible type of audio. E.g. for a news program, one specific reproduction mode is used, for a film another specific reproduction mode is used etc. However, the inventors have realized that such an approach is likely to be inaccurate as the preferred spatial reproduction may not be directly linked to the specific type of audio.

Indeed, the inventors have realized that a substantially improved experience can often be achieved by implementing a dynamic real time selection of a suitable reproduction mode. The inventors have further realized that advantageous performance can be achieved by implementing such a dynamic selection based on a spatial property of the input signal. Thus, in the system of FIG. 1, the reproduction mode is dynamically selected based on a spatial property of the input signal. Thereby, a real time and fast adaptation of the reproduction mode to the specific variations in the input signal is achieved.

Such an approach allows the sound reproduction to automatically and dynamically be adapted to the current characteristics of the signal thereby allowing an enhanced listening experience. The approach furthermore allows a very fast adaptation which permits the reproduction mode to be optimized for the current characteristics and preferences rather than to an average or expected characteristic e.g. for the specific type of audio or the specific program type the audio represents. For example, the approach allows the reproduction mode to change dynamically and automatically during a sound track of a film such that e.g. both dialogue and action sounds are reproduced by the most suitable reproduction algorithm for that specific sound. E.g. it is known that the spatial image often changes continuously over the duration of a media item. For example, a movie audio scene may contain an alternation between wide stereo audio scenes and moments when only one sound source, such as a voice of an actor, is audible. In the first case it is desired that stereo image is wide and immersive while in the second case it is natural to have a clearly localized spatial location for the voice. The system of FIG. 1 provides for an automatic adjustment of the reproduction mode to reflect such preferences.

Specifically, the system of FIG. 1 comprises an analyzer 107 which is arranged to determine a spatial property of the multi-channel audio signal. The spatial property may specifically be an indication of the degree of spatial organization or complexity which is present in the input signal. The spatial property may be indicative of a degree of spatial spreading, and may in particular be indicative of whether the input signal is characterized by one or more single well defined sound sources or is more characterized by an ambient sound without strong directional cues.

The analyzer 107 is coupled to a selection processor 109 which is fed the spatial property and which is arranged to select a reproduction mode from the plurality of sound reproduction modes that can be used by driver circuit 103. The selection processor 109 is further coupled to the driver circuit 103 and controls this to use the selected reproduction mode. Thus, as the spatial property varies, the selection processor 109 dynamically and automatically switches between the reproduction modes to provide the optimal reproduction processing for the current characteristics. Thus, an improved spatial experience is achieved.

The system is specifically arranged to allow a short term adaptation of the reproduction mode to the signal characteristics. Thus, a fast switching may be allowed thereby allowing the spatial reproduction to not only be optimized on (a long term) average but also to match the more instantaneous signal variations.

Accordingly, the analyzer 107 is arranged to generate an estimate in the form of the spatial property which is low pass filtered or averaged but with a relatively high frequency. Similarly, the actual switching between reproduction modes may be performed with a relatively high frequency. Thus, rather than select a reproduction mode and use this throughout e.g. a program, the system of FIG. 1 dynamically adapts the reproduction mode to match the short term variations in the signal characteristics.

The preferred dynamic characteristics of the system may depend on the specific characteristics and preferences of the individual embodiment.

However, in many embodiments, a particularly advantageous performance may be achieved with a system that allows updates of the reproduction mode at intervals that range from typically around 50 ms to 5 minutes. The exact dynamic nature may be selected based on a trade-off between the accuracy of the adaptation to the current signal characteristics and the reliability of the system and the degree of any artefacts associated with switching between different modes.

In many embodiments, the low pass filtering included when determining the spatial property advantageously has a 3 dB cut-off frequency exceeding 0.001 Hz, 0.01 Hz, 0.1 Hz, 1 Hz, 10 Hz or 50 Hz depending on the specific preferences of the individual embodiment. Correspondingly, the spatial property may advantageously be determined with a time constant of less than 500 seconds, 100 seconds, 10 seconds, 1 second, 500 ms, 100 ms or even 50 ms. The time constant may be defined as the time it takes the spatial property to reach 1-1/e•63% of its final (asymptotic) value following a step change. For example, the spatial property may track or be dependent on one or more spatial characteristics of the multi-channel signal. A step change in this spatial characteristic while maintaining all other parameters constant will result in a change in the spatial property. The time constant for determining the spatial property may then be measured as the time it takes for this change to reach 1-1/e•63% of its final (asymptotic) value.

Similarly, the switching may be arranged in accordance with similar dynamics. Specifically, the maximum switch frequency for switching between reproduction modes may exceed 0.01 Hz; 0.1 Hz, 1 Hz or even 10 Hz. The maximum frequency may be the fastest switching possible due to the determination of the spatial property and/or the actual switching operation. Thus the maximum switching frequency may be the highest frequency variation in the underlying spatial characteristics of the audio signal that the system can follow.

In the specific embodiment, the driver circuit 103 is arranged to switch between four different reproduction modes.

In the first reproduction mode, the driver circuit 103 simply maintains the original stereo signal and does not introduce any spatial modification. Thus, this mode of operation maintains the spatial characteristics of the multi-channel input signal. In the specific example, the stereo input signal is simply reproduced as a stereo signal, i.e. the left input channel is fed to the left loudspeaker and the right input channel is fed to the right loudspeaker and no signal is fed to the center loudspeaker. Thus, in this reproduction mode the driver circuit 103 provides a stereophonic reproduction of the original audio channels.

In the second reproduction mode the driver circuit 103 reproduces the input signal as a mono signal. For example, the two stereo channels may be combined (e.g. by a simple summation) and the resulting mono signal may be fed to the center loudspeaker with no signal being fed to either the left or right loudspeaker. Thus, the second reproduction mode of the driver circuit 103 includes a down-mixing of the input signal and is a monophonic reproduction mode. Such a reproduction mode may be particularly advantageous etc in scenarios wherein the audio corresponds to a single centrally placed sound source, such as e.g. that of a news reader for a news program.

In the third reproduction mode, the driver circuit 103 is arranged to introduce spatial widening processing. In the specific example the third reproduction mode comprises applying a stereo widening algorithm to the input stereo signal. Such stereo widening tends to provide a decorrelation of the stereo channels such that a perception of an enlarged spatial image is achieved. It will be appreciated that various spatial widening techniques will be known by the skilled person and that any suitable algorithm can be used without detracting from the invention.

Such processing may be particularly advantageous when the sound image is dominated by ambient sounds rather than specific localized sound sources. For example, it may provide an enhanced experience when reproducing music created by a large orchestra with many instruments.

In the fourth reproduction mode, the driver circuit 103 separates the input signal into one or more primary source signals where each primary signal seeks to comprise sound only from a specific dominant sound source. It will be appreciated that the skilled person will be aware of different algorithms for detecting and extracting dominant sound sources and that any suitable algorithm may be used without detracting from the invention. The driver circuit 103 further generates a residual signal corresponding to the signal after the extraction of the dominant sound source(s). In the fourth reproduction mode, the input stereo signal is thus decomposed into one or more primary sound source signals and ambient stereo or surround signals.

The dominant sound source signal and the residual signal are then processed differently such that a different spatial processing is applied to the signals. As a simple example, spatial widening may be applied to the residual signal but not to the dominant sound source signals. Thus, the spatially well defined positioning of the dominant sound sources is not modified whereas an enhanced sound image is achieved for the residual signal which typically corresponds to an ambient sound environment. Furthermore, the dominant sound source signal may e.g. be presented in the center spatial channel and the residual signal may be presented in the right and left spatial channels. Thus, in this reproduction mode, all spatial channels provided by the set of loudspeakers are used and the mode comprises an upmixing of the input signal.

Methods to estimate a spatial source distribution from audio channels have been proposed. For example, a method for the determination of the direction of the prominent sound source from multi-channel audio data and estimate of the ambient sound level was proposed in M. Goodwin and J-M. Jot, 'Multichannel surround format conversion and generalized upmix', AES 30th int. Conference, Finland, March 2007. Two other methods for the estimation of the distribution of multiple sound sources in a stereo mixture was studied, e.g., in A. Härmä and C. Faller "Spatial decomposition of time-frequency regions: subbands or sinusoids", AES 116th Convention, Berlin, Germany, 8-11 May 2004.

The fourth reproduction mode may be particularly suitable for e.g. signals that are a mix between specific sound sources and ambient sound or noise.

The analysis of the spatial distribution of sound sources in the input signal by the analyzer 107 may for example be based on frequency-selective analysis of audio energy within each channel and/or frequency-selective analysis of the variation of some suitable numerical measures that represent the similarities between the channels. For example, the analyzer 107 may use analysis methods similar to the ones used in the MPEG Surround standard. Thus, they may be based on subband decomposition of the input signals and the computation of energy and covariance values between frequency subbands in different channels. However, it will be appreciated that many other approaches may be used such as e.g. correlation metrics related to parametric representations of the signals and/or mutual information characterizing the similarity between different channels.

Figure 2:
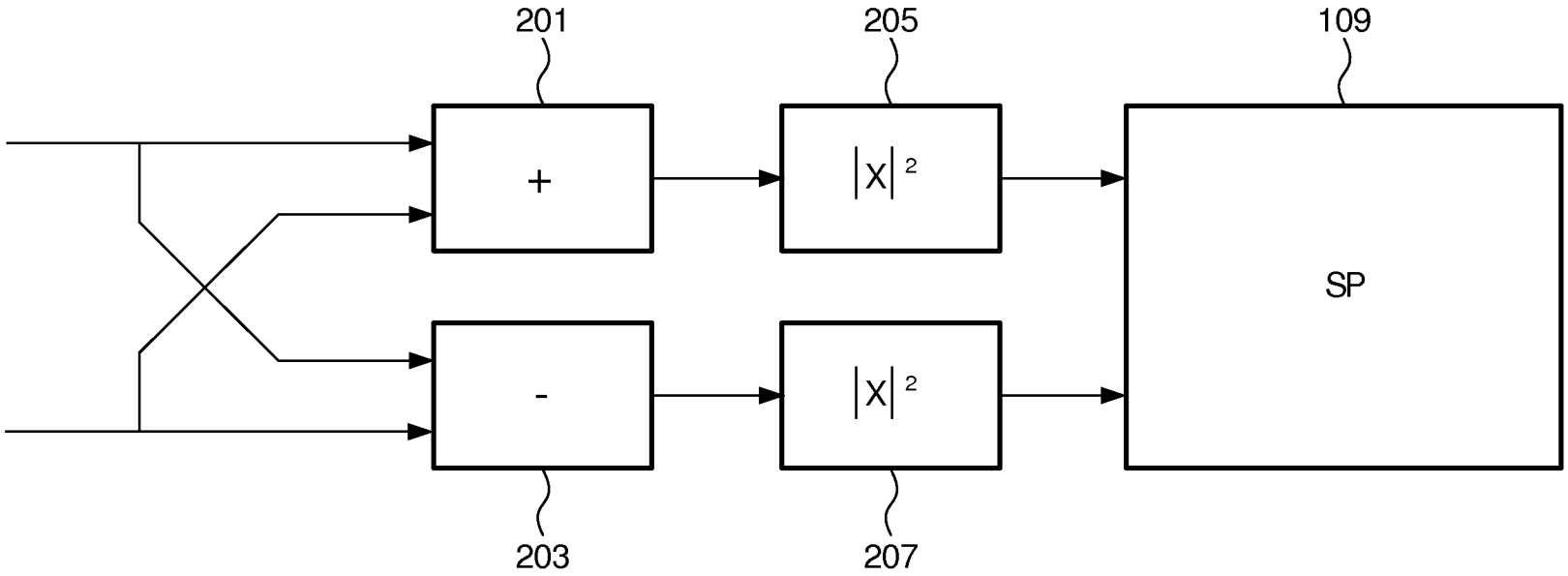
FIG. 2 is an illustration of an example of elements of a system for spatial sound reproduction in accordance with some embodiments of the invention.

FIG. 2 illustrates a specific approach that may be used in the system of FIG. 1.

In the example, the analyzer 107 comprises a summer 201 and a subtractor 203 which are fed the input left and right signals. The summer adds the two signals together and the subtractor 203 subtracts one from the other. The summer 201 is fed to a first energy estimator 205 which calculates the signal energy of the sum signal generated by the summer 201. The subtractor 203 is fed to a second energy estimator 207 which measures the signal energy of the difference signal generated by the subtractor. The first and second energy estimators 205, 207 are coupled to the selection processor 109 which selects the reproduction mode based on the spatial property indication of the sum and difference energies.

Thus, in the example, the selection of the reproduction mode is based on the computation of the sum and difference signals between the left and right channel signals and a comparison of the short-time energies of the signals. When the energy of the sum signal is significantly larger that the difference signal, it is estimated that the input stereo signal is substantially monophonic. When the energies of the sum and difference signal are at the same level or the energy of the difference signal is larger that the energy of the sum signal the input signal is considered to be a regular stereo audio signal.

Thus a detection value in each energy analysis period may be given by $$\rho = \begin{cases} 1, & \text{if } E_{sum} > AE_{diff} \\ 0, & \text{if } E_{sum} \leq AE_{diff} \end{cases}$$

where $E_{sum}$ and $E_{diff}$ are the short-time energies of the sum and difference signals respectively, and A is a scalar coefficient which is typically significantly larger than one (e.g., A=100).

The operation of the driver circuit 103, and specifically the switch between different reproduction modes, may be implemented as a dynamic matrix operation $$\begin{pmatrix} y_l(n) \\ y_r(n) \\ y_c(n) \end{pmatrix} = \begin{pmatrix} 1-p(n) & 0 \\ 0 & 1-p(n) \\ \frac{p(n)}{2} & \frac{p(n)}{2} \end{pmatrix} \begin{pmatrix} x_l(n) \\ x_r(n) \end{pmatrix}$$

Where $x_l(n)$ and $x_r(n)$ are original left and right stereo signals, n is an index for the samples digital signals. The outputs $y_l(n)$, $y_r(n)$, and $y_c(n)$ are the drive values for the left, right and center speakers respectively.

Thus, in the example, the signal energies of the sum and difference signals is used to switch between a substantially monophonic reproduction using the center speaker and a stereo reproduction using the left and right speakers.

As another example, the sum and difference operations may be replaced by more generalized operations. For example, the direction of the dominating sound source may be estimated by principal component analysis (PCA) (or other similar methods such as adaptive Eigenvalue decomposition). Further, weighted sums and differences may be used such that the dominating sound source is eliminated from the difference signal. This may lead to a structurally very similar but more generalized solution than the example of FIG. 2.

The described approach may e.g. be applied independently in different frequency intervals, such as e.g. in individual frequency bins generated by a Fourier transform, or in frequency subbands of a filterbank.

In the specific example, the above approach is first used to determine where the input signal has a substantially monophonic character. If so, the second reproduction mode (monophonic representation) is used. If not, i.e. if ρ=0, further processing is performed to select which of the other reproduction modes is to be used. These reproduction methods may specifically be switched between by appropriately switching the processing that is applied to $x_l(n)$ and $x_r(n)$. For example, for the first reproduction mode (maintaining the spatial characteristics of the input signal), the input channels are used directly as $x_l(n)$ and $x_r(n)$ (and thus $y_l(n)$ and $y_r(n)$) whereas for the third reproduction mode (widening), spatial widening is first applied to the input signals before they are used as $x_l(n)$ and $x_r(n)$ (and thus $y_l(n)$ and $y_r(n)$) and fed to the loudspeakers.

In some embodiments, the analyzer 107 may determine a dominant sound source signal comprising one or more dominant sound sources. A residual signal may then be generated representing the signal remaining after the dominant sound source(s) have been extracted. Finally, the spatial property may be determined in response to an energy indication for the dominant sound source signal relative to an energy indication for the residual signal.

For example, directional filtering techniques may be used to extract a dominating source from the stereo mixture of the input signal. This extraction may use any suitable technique for multi-channel signal decomposition, including beamforming algorithms, adaptive beamforming algorithms, blind source separation algorithms, and methods for multi-channel noise suppressions, as will be known to the skilled person.

After the extraction of the dominating (or primary) source from the mixture, the multi-channel residual signal is determined where the dominating sound source has been eliminated or suppressed.

In this case the detection value may be calculated as:

$$\rho = \begin{cases} 1, & \text{if } E_{prim} > BE_{ros} \\ 0, & \text{if } E_{prim} < BE_{res} \end{cases}$$

where $E_{prim}$ is the energy measure for the dominant or primary sound source signal and $E_{res}$ is the energy measure for the residual signal. The value of the parameter B is typically around unity depending on the specific characteristics of the primary signal extraction. If the energy of the extracted dominating source is low compared to the residual, the system determines that the mixture does not contain a dominant/primary sound source. In this case, the third reproduction method may be selected to provide an enhanced spatial image.

Otherwise the apparatus may proceed to evaluate if the residual signal contains another dominating sound source. This may for example be done by applying the primary source separation iteratively to the residual signal. As another example, the determination may be based on a calculation of similarity measures between the multi-channel signals. Typical similarity measures are various types of weighted correlation metrics such as the Pearson correlation, estimates for the maximum value of the correlation function or a normalized correlation function. It is also possible to use various types of magnitude difference functions or information theoretical measures such as mutual information. If the measure shows low similarity between the two residual signals, this is indicative of the presence of a single dominant sound source with some ambient signal (as the signal was previously found not to be substantially monophonic). Accordingly, the fourth reproduction mode may be used with the dominant or primary source signal being reproduced with no spatial widening (and e.g. as a mono signal fed to the center channel) whereas spatial widening is applied to the residual stereo signal which is then fed to the left and right loudspeakers.

If however the channels of the residual signal are found to have a high similarity this is likely to reflect that the input signal probably consists of two dominating sources which may be better reproduced by the first reproduction method and accordingly this is selected.

The switching between the different reproduction modes may in many embodiments advantageously be a smooth and gradual transition. This may reduce and mitigate artefacts arising from the different spatial characteristics of the different reproduction modes.

As an example, the switch from a mono mode to a stereo reproduction mode may be according to:

$$\begin{pmatrix} y_l(n) \\ y_r(n) \\ y_c(n) \end{pmatrix} = \begin{pmatrix} 1-p(n) & 0 \\ 0 & 1-p(n) \\ \frac{p(n)}{2} & \frac{p(n)}{2} \end{pmatrix} \begin{pmatrix} x_l(n) \\ x_r(n) \end{pmatrix}$$

where $$p(n)=\alpha p(n-1)+(1-\alpha)\rho$$

where the temporal integration coefficient • is a value in the interval [0,1]. A typical value may for example be •=0.95.

As a more general example, the apparatus may be arranged to operate two (or more) of the reproduction modes simultaneously. The signals generated from the two reproduction modes that the system is switching between may then be mixed together with the weighting of the two modes being gradually changed from the previous reproduction mode to the new reproduction mode. For example, for each loudspeaker the corresponding signals generated by the two reproduction modes may be summed according to $$y(n)=\beta(n)\cdot x_p(n)+(1-\beta(n))\cdot x_n(n)$$

where y(n) is the drive signal for the speaker, $x_p$ is the sample generated by the previous reproduction mode, $x_n$ is the sample generated by the new reproduction mode, n is a sample index and • is a value that gradually changes from 1 to 0 with a suitable temporal characteristic.

In many embodiments, a transition time in the interval from 10 ms to 1 second tends to provide advantageous performance. The transition time may be measured as the time the new reproduction mode changes from a weighting of 10% to a weighting of 90% of the resulting combined signal.

In some embodiments, the drive circuit 103 is further arranged to adapt a characteristic of a spatial rendering technique of the selected reproduction mode in response to the spatial property. For example, for the third reproduction mode, the degree of spatial widening applied may be adjusted depending on the spatial priority. Thus, in such an example, the analysis of the spatial mixture of the input signal is also used to control the amount of decorrelation, or the "stereo widening parameter" of the spatial widening algorithm. E.g. if the spatial property indicates that the input signal contains a rich and wide spatial image with multiple sources or e.g. a diffuse signal with no discernable sound source, more stereo widening may be applied in the reproduction than when there is essentially the same content in both channels. The first case can be differentiated from the second case by evaluating the amount of correlation between the two audio channels.

As another example a signal may be considered where two separate sources are dominating the left and right channel, respectively. In this case the intended spatial image consists of two clearly localized separated sources in the stereo image (e.g., a duet of a singer on the left and a guitar on the right). In this case the correlation between the channels is low. If stereo widening is applied to the signals due to the correlation for the signals, the produced spatial image will be wide. However, in this case the stereo image will become blurred lacking the clearly localized character of the two intended stereo image. Therefore, it would be probably be better to use direct (non widened) stereo playback for this type of content to preserve the clearly localized sources in the image. It is possible to detect if the stereo image has a simple mixture of a small number of uncorrelated sources or if it is a complex mixture of multiple sound sources. A simple way to perform this is to analyze the normalized cross-correlation C between the left and right channel. Based on such reasoning, the selection of the reproduction mode could in some embodiments be based on the following logic:

If $C<T_{low}$, the content is considered to consists of two uncorrelated sources on the left and right and the standard (non widened) stereo reproduction is selected in order to preserve the localization of the two sources If $T_{low}<C<T_{high}$ the content is considered to be a regular complex stereo material. The stereo widening approach is accordingly used for the reproduction for this type of content.

If $T_{high}<C$, the content is considered to have one distinct source. The stereo reproduction method or a specific reproduction for monophonic content is therefore selected for this type of input.

The normalized correlation function may e.g. be the Pearson correlation given by:

$$C=E[x_l(n)x_n(n)]/\sqrt{(E[x_l(n)x_l(n)]E[x_r(n)x_r(n)])}$$

or the normalized correlation measure proposed by Avendado (C. Avendado, Frequency-domain source identification and manipulation in stereo mixes for enhancement, suppression and re-panning applications, IEEE Proc. WASPAA, N.Y., USA, 2003) which is given by $$C=2E[x_l(n)x_n(n)]/(E[x_l(n)x_l(n)]+E[x_r(n)x_r(n)]).$$

The detection can also be based on the statistics of correlation and level differences between channels in small time-frequency segments of the input signals The system of FIG. 1 may provide an improved listening experience in many scenarios and for many real life signals. In particular, the spatial experience for systems based on upmixing may be improved in many scenarios. E.g., upmixing algorithms that seek to extract a center channel from a stereo signal may provide very good performance when a central sound source is present in the sound image but may not always work ideally in the case when there is no clear center image in the stereo mixture. Indeed, if a center channel extraction method is used for such content, it may result in the reduction of the width of the stereo image. The described approach allows for the reproduction of the input signal to be dynamically adapted to use a suitable upmix approach.

Figure 3:
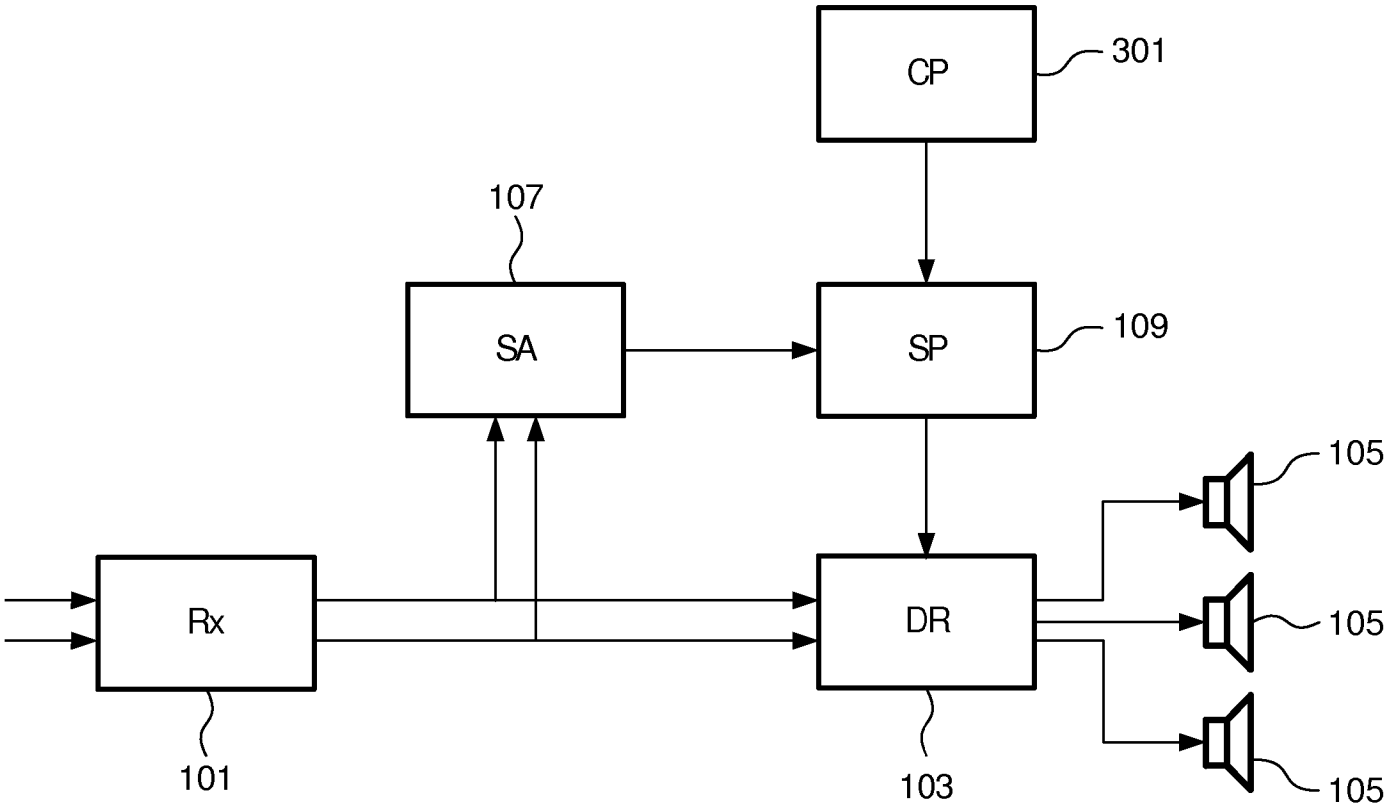
FIG. 3 is an illustration of an example of a system for spatial sound reproduction in accordance with some embodiments of the invention.

In some embodiments, the selection of the reproduction mode may further consider a content property for the input signal. An example of such is illustrated in FIG. 3 which shows the system of FIG. 1 modified to include a content processor 301 which is arranged to determine a content characteristic for the signal. The content characteristic may for example indicate a genre, a program type associated with the audio signal (e.g. if the audio is associated with a media item such as e.g. a television or a radio program), an artist associated with the audio etc.

The content characteristic may for example be determined from meta-data associated with the input signal. Thus, in some scenarios metadata may be received separately from or e.g. embedded in the audio signal. The content processor 301 may be arranged to extract the data describing the content of the input signal.

In other embodiments, the content processor 301 may be arranged to perform a content analysis on the received input signal and determine the content characteristic based on such a content analysis. For example, the content processor 301 may analyze the signal to determine whether it predominantly contains speech, music or e.g. loud explosions. It may then estimate the corresponding type of content, such as e.g. select between a news program, a music program and an action film, based on the analysis. It will be appreciated that different content analysis approaches will be known to the skilled person and that any suitable algorithm may be used. For audiovisual signals (i.e. where the input audio signal is coupled with a video signal), the content analysis may alternatively or additionally be based on the video signal associated with the input signal.

The content characteristic is fed to the selection processor 109 which proceeds to include it in the selection of the reproduction mode to use. Specifically, the short term switching between different reproduction modes may still be determined based on the short term variations of the spatial property but the exact switching criteria may be modified dependent on what the content is. For example, the system may be more likely to switch to a spatial widening approach for an action movie than it is for a news program.

Thus, data indicative of the content type may be used in selecting the optimal spatial reproduction method to use. Specifically, the content characteristic may be used to enhance the reliability of the reproduction mode-selection strategy. Including the content characteristic in the decision can reduce the risk of an inappropriate reproduction mode being selected.

For example, in some cases the spatial analysis of the signal may result in a spatial property that does not clearly indicate a suitable reproduction mode. In this case, it may be desirable to consider the content when selecting the reproduction mode. Thus, the content characteristic may be considered in cases where the spatial signal analysis does not clearly classify the spatial mixture of the signal in one of the four reproduction classes, but is in an uncertain "grey" region between two or more of them. In some embodiments, the intervals of the spatial property that correspond to each of the reproduction modes may e.g. depend on the specific property. This may e.g. result in the selection between the unmodified stereo reproduction mode and the widened stereo reproduction mode being different e.g. for a news program and an action film. Thus, the widening may be used less for the news program than for the action film.

In some embodiments, the driver circuit 103 may adapt a characteristic of a spatial rendering technique of the selected reproduction mode in response to the content characteristic. Thus, the content characteristic reflecting information about the content type of the input signal may be used to control parameters of the selected spatial reproduction mode. For example, the amount of widening that is applied when the system decides that stereo widening is the optimal reproduction method may be adjusted depending on the content type. For this purpose, the classification of content type might be done on a high level, for example distinguishing between classes like "news", "movie", "music", "documentary" etc. It could, however, also be beneficial to do a classification in sub-types, for example different genres of music or different types of movies. For example, certain genres of music are typically associated with a rather intimate sound stage and acoustical atmosphere (e.g. singer-songwriter or chamber music), while other genres are associated with a wide sound stage and very spacious room acoustics (e.g. choir music). Knowing the musical genre can, in addition to the analysis of the spatial mixture of the audio signal, help to select the appropriate reproduction mode and/or to set the parameters of the spatial reproduction mode.

The above description has focused on embodiments wherein the set of loudspeakers provide more spatial channels (specifically three spatial channels) than the input signal (specifically two channels). However, it will be appreciated that in other embodiments the set of loudspeakers may not provide more spatial channels than the input signal.

Indeed, in many embodiments, it may be advantageous for the set of loudspeakers to provide fewer spatial channels than the input signal. For example, a seven channel surround sound input signal may be reproduced in three spatial channels. In such embodiments, potentially complex spatial processing may be used to provide advantageous performance and the described principles may be used to select which reproduction mode to apply to the specific spatial characteristics of the input signal. Thus, different down-mixing algorithms may be used dependent on the spatial characteristic of the input signal.

It will be appreciated that the above description for clarity has described embodiments of the invention with reference to different functional circuits, units and processors. However, it will be apparent that any suitable distribution of functionality between different functional circuits, units or processors may be used without detracting from the invention. For example, functionality illustrated to be performed by separate processors or controllers may be performed by the same processor or controllers. Hence, references to specific functional units or circuits are only to be seen as references to suitable means for providing the described functionality rather than indicative of a strict logical or physical structure or organization.

The invention can be implemented in any suitable form including hardware, software, firmware or any combination of these. The invention may optionally be implemented at least partly as computer software running on one or more data processors and/or digital signal processors. The elements and components of an embodiment of the invention may be physically, functionally and logically implemented in any suitable way. Indeed the functionality may be implemented in a single unit, in a plurality of units or as part of other functional units. As such, the invention may be implemented in a single unit or may be physically and functionally distributed between different units, circuits and processors.

Although the present invention has been described in connection with some embodiments, it is not intended to be limited to the specific form set forth herein. Rather, the scope of the present invention is limited only by the accompanying claims. Additionally, although a feature may appear to be described in connection with particular embodiments, one skilled in the art would recognize that various features of the described embodiments may be combined in accordance with the invention. In the claims, the term comprising does not exclude the presence of other elements or steps.

Furthermore, although individually listed, a plurality of means, elements, circuits or method steps may be implemented by e.g. a single circuit, unit or processor. Additionally, although individual features may be included in different claims, these may possibly be advantageously combined, and the inclusion in different claims does not imply that a combination of features is not feasible and/or advantageous. Also the inclusion of a feature in one category of claims does not imply a limitation to this category but rather indicates that the feature is equally applicable to other claim categories as appropriate. Furthermore, the order of features in the claims do not imply any specific order in which the features must be worked and in particular the order of individual steps in a method claim does not imply that the steps must be performed in this order. Rather, the steps may be performed in any suitable order. In addition, singular references do not exclude a plurality. Thus references to "a", "an", "first", "second" etc do not preclude a plurality. Reference signs in the claims are provided merely as a clarifying example shall not be construed as limiting the scope of the claims in any way.

The invention claimed is:

1. An apparatus for spatial sound reproduction, the apparatus comprising:

a receiver for receiving a multi-channel audio signal;

a circuit for determining a spatial property of the received multi-channel audio signal;

a circuit for generating a mode selection signal for automatically selecting a selected reproduction mode from a plurality of sound reproduction modes in response to the determined spatial property, the sound reproduction modes employing different spatial rendering techniques; and a reproduction circuit coupled to the receiver to receive the multi-channel audio signal, said reproduction circuit having circuitry for generating drive signals from the multi-channel audio signal for driving a set of spatial channels provided by a set of loudspeakers, said circuitry processing the multi-channel audio signal in response to the mode selection signal to generate the drive signals in accordance with the selected reproduction mode, wherein the plurality of sound reproduction modes comprises at least two of:

a monophonic reproduction mode, a reproduction mode maintaining spatial characteristics of the multi-channel signal as received by the receiver, a reproduction mode comprising spatial widening processing, and a reproduction mode comprising a separation into at least one dominant source signal and an ambiance signal, and applying different spatial reproduction of the at least one primary source signal and the ambiance signal, wherein said apparatus further comprises:

a circuit for determining a content characteristic for the multi-channel audio signal, wherein the circuit for selecting is arranged to further generate the mode selection signal for selecting the selected reproduction mode in response to the content characteristic and wherein the reproduction circuit is arranged to receive the content characteristic, and the circuitry for generating the drive signals from the multi-channel audio signal is arranged to adapt a characteristic of a spatial rendering technique of the selected reproduction mode in response to the content characteristic.

2. The apparatus as claimed in claim 1, wherein at least one of the sound reproduction modes comprises at least one of: an up-mixing to higher number of spatial channels than a number of channels of the multi-channel audio signal; and a down-mixing to a lower number of spatial channels than the number of channels of the multi-channel audio signal.

3. The apparatus as claimed in claim 1, wherein the set of spatial channels comprises a different number of channels than the multi-channel audio signal.

4. The apparatus as claimed in claim 1, wherein said selecting circuit and said reproduction circuit effect a switching in the reproduction circuit between sound reproduction modes, and wherein a maximum switch frequency for switching between sound reproduction modes exceeds 1 Hz.

5. The apparatus as claimed in claim 1, wherein the circuit for determining the spatial property is arranged to determine the spatial property with a time constant of no more than 10 seconds.

6. The apparatus as claimed in claim 1, wherein the circuit for determining the content characteristic is arranged to determine the content characteristic in response to meta-data associated with the multi-channel audio signal.

7. The apparatus as claimed in claim 1, wherein the reproduction circuit circuitry for generating the drive signals from the multi-channel audio signal is arranged to gradually transition from a first selected reproduction mode to a second selected reproduction mode.

8. The apparatus as claimed in claim 1, wherein the circuit for determining the spatial property is arranged to determine the spatial property in response to an energy indication for a combined signal of at least two channels of the multi-channel audio signal relative to an energy indication for a difference signal of the at least two channels.

9. The apparatus as claimed in claim 1, wherein the circuit for determining the spatial property is arranged to decompose the multi-channel audio signal into at least one dominant sound source signal and a residual signal, and to determine the spatial property in response to an energy indication for the dominant sound source signal relative to an energy indication for the residual signal.

10. The apparatus as claimed in claim 1, wherein the reproduction circuit is arranged to receive the spatial property from the spatial property determining circuit, and the reproduction circuit circuitry for generating the drive signals from the multi-channel audio signal is arranged to adapt a characteristic of a spatial rendering technique of the selected reproduction mode in response to the spatial property.

11. The apparatus as claimed in claim 10, wherein the characteristic is a degree of spatial widening applied to at least two channels of the multi-channel audio signal.

12. A method of spatial sound reproduction, the method comprising:

receiving a multi-channel audio signal;

determining a spatial property of the received multi-channel audio signal;

generating a mode selection signal for automatically selecting a selected reproduction mode from a plurality of sound reproduction modes in response to the determined spatial property, the multi-channel sound reproduction modes employing different spatial rendering techniques; and generating drive signals for driving a set of spatial channels provided by a set of loudspeakers by processing the received multi-channel audio signal in accordance with the reproduction mode as indicated by the mode selection signal, wherein the plurality of sound reproduction modes comprises at least two of:

a monophonic reproduction mode, a reproduction mode maintaining spatial characteristics of the received multi-channel signal, a reproduction mode comprising spatial widening processing, and a reproduction mode comprising a separation into at least one dominant source signal and an ambiance signal, and applying different spatial reproduction of the at least one primary source signal and the ambiance signal, wherein said method further comprises:

determining a content characteristic for the multi-channel audio signal, wherein the step of generating a mode selection signal further generates the mode selection signal for selecting the selected reproduction mode in response to the content characteristic, and wherein the step of generating the drive signals further generates the drive signals from the multi-channel audio signal by adapting a characteristic of a spatial rendering technique of the selected reproduction mode in response to the content characteristic.

* * * * *